US006524503B2

(12) United States Patent
Gazit et al.

(10) Patent No.: US 6,524,503 B2
(45) Date of Patent: Feb. 25, 2003

(54) PROCESS FOR THE MANUFACTURE OF POLYAMIDE YARNS DYEABLE IN MELANGE SHADES

(75) Inventors: Samuel Gazit, Givat-Avni (IL); Ran Rotem, Ramat-Ishay (IL); Uri Afek, Kiryat Tivon (IL); Martin Blutstein, Tivon (IL); Alon Weiser, Netanya (IL)

(73) Assignee: Nilit Ltd. (IL)

( * ) Notice: Subject to any disclaimer, the term of this patent is extended or adjusted under 35 U.S.C. 154(b) by 0 days.

(21) Appl. No.: 09/798,781

(22) Filed: Mar. 2, 2001

(65) Prior Publication Data

US 2002/0142160 A1 Oct. 3, 2002

(30) Foreign Application Priority Data

Feb. 1, 2001 (IL) ..... 141240

(51) Int. Cl.[7] ..... D01D 5/08; D01F 6/60; D02G 3/02; D06P 3/82

(52) U.S. Cl. ..... 264/78; 8/494; 8/531; 8/924; 28/247; 57/287; 264/103

(58) Field of Search ..... 264/78, 103; 8/494, 8/497, 531, 924; 28/247; 57/287

(56) References Cited

U.S. PATENT DOCUMENTS 3,511,815 A 5/1970 Sayin
4,017,255 A 4/1977 Cobb
4,059,949 A 11/1977 Lee
4,295,329 A 10/1981 Windley

FOREIGN PATENT DOCUMENTS

EP 0 409 093 A2 1/1991
JP 7-70852 A 3/1995

OTHER PUBLICATIONS

Abstract of KR9411305 published May 12, 1994.

Challenges in the Art and Science of Dying, AATCC symposium (No. 32), 1983, Kobsa, Henry and Beare, Steven D., "The Effect of Heat Setting Conditions on the Dying Rates of Heat–Set BCF Yarns".

*Primary Examiner*—Leo B. Tentoni
(74) *Attorney, Agent, or Firm*—Lerner, David, Littenberg, Krumholz & Mentlik, LLP

(57) ABSTRACT

A process for the manufacturing of a differentially dyeable yarn includes the steps of: a) producing two polymers having a different concentration of amine end-groups; b) spinning yarns from said two polymers; and c) producing a yarn by intermingling said spun yarns made from said two polymers, in texturing, or draw twisting, or draw winding processes.

14 Claims, 2 Drawing Sheets

PROCESS FOR THE MANUFACTURE OF POLYAMIDE YARNS DYEABLE IN MELANGE SHADES

FIELD OF THE INVENTION

The present invention relates to a process for the manufacture of polyamide yarns that improves the dyeing of melange cloth. More particularly, the invention relates to a process by which, garments made with these yarns can be dyed such that when knitted or woven into a fabric, a melange effect is obtained. The invention particularly relates to a single-step dyeing process.

BACKGROUND OF INVENTION

When two or more different types of yarn are knitted or woven together, the resulting garment is usually non-uniform in appearance. Such non-uniformity may be exploited to provide a pleasant and fashionable result. However, in order to do so, the yarn combination and dyeing have to be carefully designed. The production and the dyeing of cloths having multiple shades and colors are known in the textile industry. In order to achieve the multiple color effect, fabric can be knitted or woven either with pre-dyed yarns or with different types of natural (grege/gray) yarns, or with combinations thereof. In order to create the required multiple-color effect, the fabric can be further dyed with one or more dyestuffs, in a single or several dyeing steps. When these coloring effects occur in fine patterns, the resulting effect is known as "heather", or "two-tone" or "melange". A particular example of this melange group, are fabrics that have different shades and depths of the same basic color.

Among other methods known in the art, the following techniques are commonly used to achieve the melange effect in a single-step dyeing process:

a) Combination of two yarns each made from a different polymer. For example, one yarn is polyamide 6,6 and the other yarn is polyester. The two yarns, or the garment made from combining these yarns, can be dyed in a single-step process by using the same dyestuff. In this process, one yarn is selectively dyed by the Nylon dyestuff (e.g. Lanaset dyestuff by CIBA-GEIGY), while the other yarn is either partially dyed, or is not dyed, by the same dyestuff.

b) Combination of two yarns made from the same polymer (e.g. polyamide 6,6), but with different polymer characteristics. Such differences could be different cross-sections (e.g. one yarn is round, while the other is tri-lobal), or different levels of luster (e.g. one yarn is "bright" since in contains no de-lustering additives, while the other is "dull", because it contains titanium dioxide or other de-lustering additives), or different DPF (denier per filament), etc.

These differences can lead to differential dyeing of the two yarns, and will result in the heather effect.

c) Combination of two or more yarns, wherein each yarn is dyed by a different dyestuff and colors in the same process. Each yarn is dyed selectively by the respective dyestuff to which it is reactive.

The above techniques suffer from several disadvantages, and particularly:

a) In the first technique, the polymer system is not all polyamide, and therefore the complete garment is not of the highest quality attainable when using only Nylon yarns. Also, when using a polyamide-compatible dye, the polyamide is dyed to the required color, while the other yarn may not be dyed at all, or may be imperfectly dyed. This may form a sharp contrast between the two yarns, leading to harsh color difference which may be unacceptable to fashion items.

b) Differences in de-lustering of the two yarns may result in mixed opacity of the garment. This may be a desired fashionable effect, but it will not render the required variation in color shades, since various levels of de-lustering hae only a small effect on the depth of color shades. This difference does not render the garment the expected "heather" appearance.

c) Combining yarns with different cross-sections has another fashionable effect, but it does not render the required variation in color shades. Yarns with triangular or rectangular cross-section are shiny, while yarns with round cross-section are dull. Combination of such yarns will affect the level of light reflection of the garment, but not the color and the color shades of the cloth.

d) Dyeing with a mixture of dyestuffs, is a complex process in which the dyestuff components may interact with one another, resulting in undesired effects.

The mechanism of Nylon dyeing has been thoroughly investigated and described in "Challenges in the Art and Science of Dyeing" AATCC symposium (No. 32), 1983. The rate of diffusion, hydrogen and ionic bonding of the dyestuff to the polymer and the dyeing mechanism have been reported.

Polyamide yarns have been dyed by two main dyestuff types: acid and disperse dyes. While the disperse dyes are substantially insensitive to the chemical composition of the polyamide molecule, the acid dyestuff, capable of forming anionic groups, may be chemically associated with the amine end-group of the polyamide molecular backbone. Even small changes in the amine end-groups content, may affect the uptake of the acid dyestuff by the yarn in the dyeing bath, and thus affect the depth of the dyeing and the color intensity of the garment. The process of controlling the dyeing depth of Nylon by acid dyestuff via variation in the amine end-group concentration is well known in the art. U.S. Pat. No. 3,511,815 teaches that by obtaining high amine-end group (120–150 meq/kg), the Nylon 6,6 exhibits increased dyeability.

U.S. Pat. No. 4,017,255 teaches a process for the manufacturing of fiber materials containing at least two groups of differentially dyed Nylon filaments, each having a different carboxyl end-group content.

U.S. Pat. No. 4,295,329 discloses a method for making a continuous filament heather dyeable yarn involving cobulking in a hot fluid jet process a first unbulked yarn with a second previously bulked yarn. This patent teaches the use of a first yarn which contains cationically sulfonate dye sites, and of a second yarn which is of regular or deep acid-dyeing capability. The process described in U.S. Pat. No. 4,295,329 is suitable in principle for the carpet trade. It is suitable for the preparation of heavy denier bulked yarns within the range of 1500–5000 total denier. In addition, this process is based on combining different lengths of yarns.

European patent application EP 409,093 teaches a method for reducing the number of amine end groups by reacting polyamide fibers and combining them with normal polyamide fibers, thus resulting in a two-tone yarn. This process is mainly useful for stainblocking in the carpet industry.

U.S. Pat. No. 4,059,949 teaches the production of heather yarns formed by a combination of two different polymers. JP 7070852 teaches the use of acrylic yarns with melange shades. KR 9411305 teaches the preparation of polyester yarns having a two-tone effect. This yarn is used to prepare shrinkable plastics.

Polyamide yarns made from Nylon 6,6, 6,9 and 6,10 can be used in the textile industry in both knitting and weaving with high efficiency to form high quality and fashionable garments. These polymers, especially Nylon 6,6 are used in the production of knitted leg-wear and body-wear garment. In these products, dyeing efficiency and cost effective dyeing processes are important considerations.

The present invention is a single-step dyeing process, and thus it is a cost-effective alternative to other known methods.

It is a purpose of the present invention to provide a method for chemically forming the various polyamides 6,6, 6,9, 6,10—based yarns of modified dyeability properties. These yarns can be combined in a texturing or in a draw twisting, or in a draw winding process into a double-ply yarn having the capacity of creating the fashionable melange effect following dyeing.

It is another purpose of this invention to provide a process to dye the combined (double-ply) yarn in a single-step and inexpensive process.

It is yet another object of the present invention to provide for the production of a quality garment having multiple shades of the same color ("heather effect").

Other purposes and advantages of the invention will become apparent as the description proceeds.

SUMMARY OF INVENTION

The invention relates to a process of manufacturing a yarn, that when knitted or woven into garments, and then dyed, results in a fashionable melange effect of the garment.

In one aspect, the invention is directed towards providing a process for manufacturing of differentially dyeable yarn comprising steps of producing two polymers having a different concentration of amine end-groups, spinning yarns from said polymers, and producing a yarn by intermingling said spun yarns made from said two polymers in texturing, or draw twisting, or winding processes.

According to preferred embodiments of the invention, the difference in the concentration between the amine end-groups is at least 40 meq/kg. According to another preferred embodiment of the invention, the amine end-group concentration of the first polymer is in the range of 20–50 meq/kg, and that of the second polymer is in the range of 60–95 meq/kg.

According to still another preferred embodiment of the invention, the polymers are selected from Nylon 6,6, Nylon 6,9 and Nylon 6,10.

According to preferred embodiment of the invention, a dyeable yarn comprising the two polymers having a different concentration of amine end-groups, wherein fibers from said two polymers have been intermingled to produce a yarn. The number of intermingling points produced in the yarn is between 10–75 points/meter.

According to preferred embodiment of the invention, the first yarn is made of Nylon 6,6 and the second yarn is also made from Nylon 6,6, or is made from a different polyamide.

According to one embodiment of the invention, the dyeing is carried out in a single step and the dyestuff is acid dyestuff, selected from the Tectilon family for light colors, and selected from the Lanaset family for dark colors.

All the above and other characteristics and advantages of the invention will be further understood through the following illustrative and non-limititative examples.

DETAILED DESCRIPTION

Figure 1:
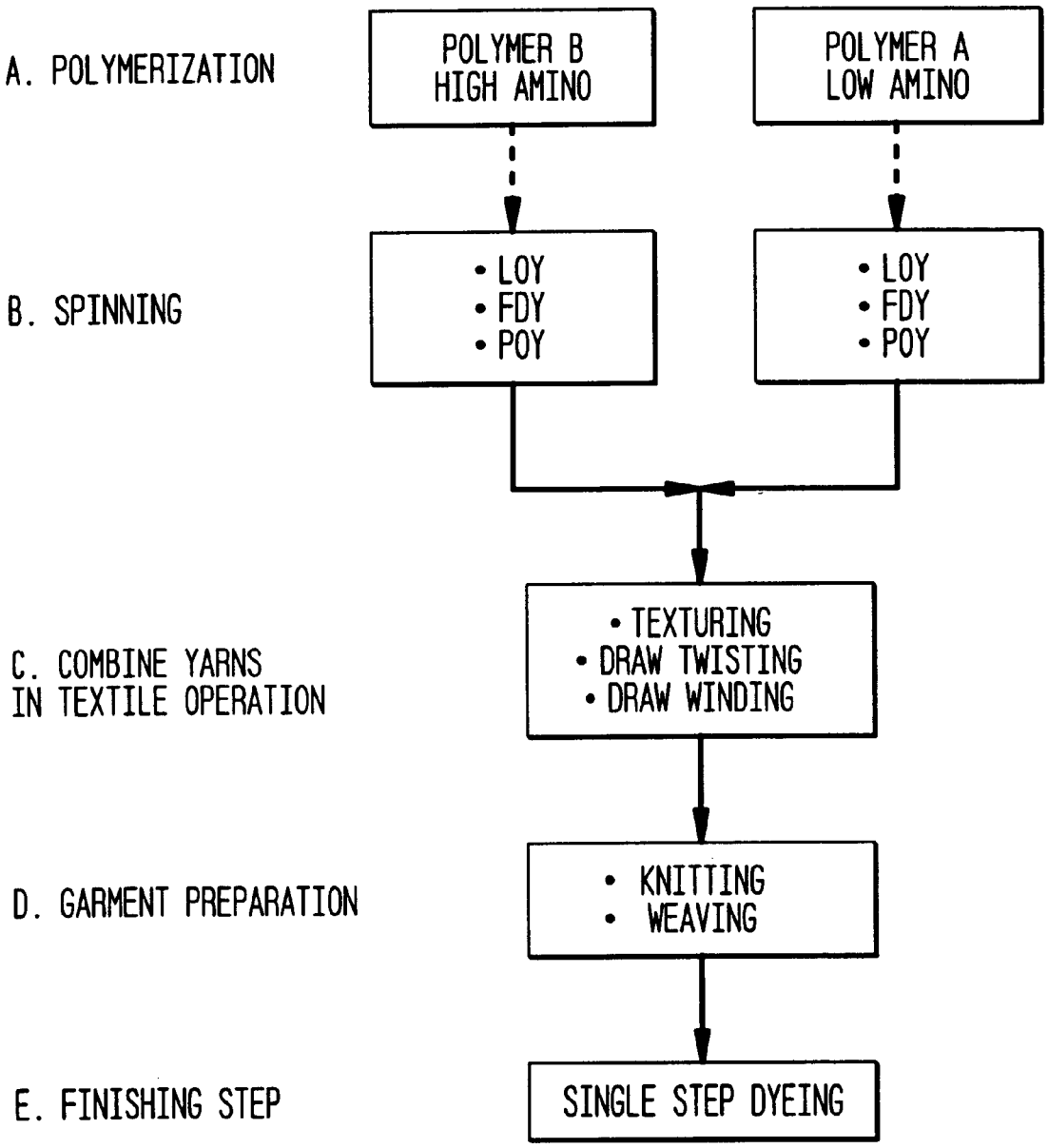
FIG. 1 is a schematic representation of the production sequence of a melange fashionable article.

The invention relates to a process of manufacturing a yarn, that when knitted or woven into garments, and then dyed in a single-step process, results in a fashionable effect of the garment. In order to achieve the above effect, the yarn is carefully produced through polymerization, spinning and known textile processes to yield the desired product. The production steps are schematically illustrated in FIG. 1, and are as follows:

a) The yarn with the melange effect consists of two basic yarns each made out from a different polymer. Each polymer is characterized by a different concentration of amine end-groups.

b) The two polymers are spun separately in Low Oriented Yarn (LOY), or Partially Oriented Yarn (POY) or Fully Drawn Yarn (FDY) processes.

c) The yarns from step (b), having different amino end-group concentrations are then combined to form the melange yarn in either a texturing process, or in a draw-winding process, or in a draw-twisting process.

d) The textured or the FLAT, (a drawing process which results in a flat yarn) melange yarn is then woven or knitted into a textile garment by knitting machine, or in wrap knitting machine, to form a textile article.

e) The textile article is then dyed in a single dyeing process to form a textile article with the desired melange effect.

The present invention deals with yarns made from polyamides, particularly Nylon 6,6 poly (hexamethylenediamine-co-adipic acid, Nylon 6, 9 poly (hexamethylenediamine-co-azelaic acid), and Nylon 6,10 poly-(hexame- thylenediamine-co-sebacic acid) and thus, have the advantage of achieving high quality Nylon properties with respect to tenacity, abrasion resistance, elongation, thermal properties and chemical resistance.

In order to achieve the melange effect in the final product, it is important to control the polymerization step of the two polymer components. The desired fashionable melange effect is obtained when the differences between the amine end-grounps of the two polymers are at least 40 milli-equivalents/kg (mes/kg). Thus, the amine end groups concentration of polymer A is 20–50 meg/kg, and preferably about 45 meg/kg, while the amine end-group concentration of polymer B is 60–95 meg/kg, and preferably about 85 meq/kg. The relative viscosity of the polymers is in the range of RV=36–65.

The polymer is then converted into fibers by LOY, POY or FDY process, at typical winding speeds of 600–6000 m/min. The spinning conditions, especially for polymers with high amine end-groups is adjusted to the spinning configuration used in the process. The low amine and "high amine" yarns are typically in the range of 20–60 denier each, and when combined they form double ply yarns of 40–120 denier, suitable for textile applications. The Denier Per Filament (DPF) of these yarns is in the range of 0.7–4. At the lower DPF end, the yarns are considered micro-fibers, and as such have applications in knitting fashionable intimate apparel and leg-wear.

The LOY or the POY yarns are then processed on the texturing equipment, or draw-winding or draw-twisting machines to form the final yarn product. One yarn of the low amine end-group and one yarn of the high amine end-group are further processed and combined in a textile operation to form the final melange effect. Significantly low number of intermingling points will result in a non-uniform visual effect, while excess number of intermingling points will result in merging of the two-tones into a mixed-single color, and fading of the melange effect. The number of intermingling points that results in fashionable melange effect is in the range of 10–75 depending on the yarn DTEX (weight in grams of $10^3$ meters of yarns) and number of filaments. Intermingling points is a synonymous term to the number of nodes or interlace points in the yarn, commonly used in the man-made textile industry ["Air interlacer For Textured Yarns" SlideJet-FT, Manuel By Heberlein, Eig 07/94 (1994)].

Figure 2:
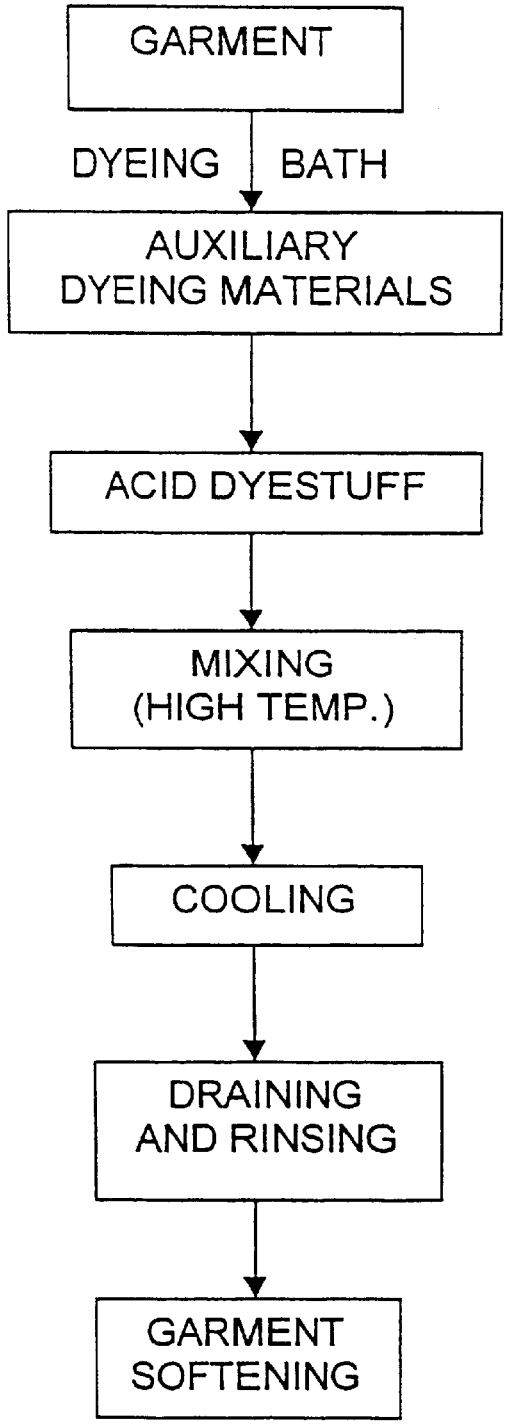
FIG. 2 is a schematic representation of the dyeing process.

The textile article is dyed in a single dyeing process. This process is schematically illustrated in FIG. 2. Both components of the melange yarn are dyed in the bath. However, each component is dyed to a different level/depth, resulting in the overall melange effect of the garment.

Typically, an acid dyestuff is used in the dyeing of the Nylon melange yarn, such as the Tectilon dyestuff family for light colors (by CIBA), or the Lanaset dyestuff family for dark colors (by CIBA). The melange yarn can be dyed by commercial acid dyestuff by a standard procedure.

The cumulative effects of the amine end-groups differences in the polymer, the DTEX and DPF choices in spinning, the method of combining the two yarns in the textile operation, and the dyeing materials and process dictate the fashionable value of the melange textile article, and those will be easily understood by the skilled person.

According to a preferred embodiment of the invention, two polyamide yarns are produced, each with a different number of amine end-groups. As said, the amine end-group level is controlled by varying the content of hexamethylenediamine in the autoclave during the polymerization process.

According to another preferred embodiment of the invention the two yarns are combined to form a double-ply yarn having the capacity of creating a fashionable melange effect upon dyeing.

According to another preferred embodiment of the invention, the combined yarn is dyed in a single-step dyeing process with an acidic dyestuff such as one of the Tectilon family for light colors, and of the Lanaset family for dark colors.

The following examples illustrate the invention and are not intended to limit it in any way.

EXAMPLE 1

Nylon 6,6 Yarns

Polymer for the First Yarn (A):

An aqueous solution of hexamethylene diamonium adipate (AH salt) is charged into a stainless steel batch autoclave, under a nitrogen blanket. The autoclave is heated in order to distill the water, at a pressure of 18 Kg/cm$^2$.

As the autoclave temperature reaches 244° C., the pressure is gradually released over a period of 40 minutes. The polymer is then discharged from the vessel under nitrogen pressure, and chilled by water. The solid polymer streams ("spaghetti") are chopped into nylon 6,6 chips. The polymer is characterized by a relative viscosity of RV=42–44, amine end-group concentration of 41–43 meq/Kg, and the concentration of the titanium dioxide is 0.3% by weight.

Polymer for the Second Yarn (B):

The process is similar to that described above for the first polymer, except that in addition to the AH salt, an aqueous solution of hexamethylene diamine (HMD) is also charged into the autoclave. The additional HMD quantity is 0.5% of the total AH salt. The resulting nylon 6,6 polymer has a relative viscosity of RV=46–48, and amine end-group concentration of 87–89 meq/Kg, and the concentration of the titanium dioxide is 0.3% by weight.

Spinning:

The nylon chips of the two polymers are spun in a POY process under the following conditions:

Each polymer is spun separately.

| Conditions | Polymer A | Polymer B |
|---|---|---|
| Relative viscosity (RV) | 43 | 47 |
| Polymer temp. (° C.) | 288 | 288 |
| Extruder pressure (atm) | 100 | 100 |
| Pack pressure (atm) | 177 | 188 |
| Spin finish concentration (%) | 0.45 | 0.45 |
| Winding speed (m/min) | 4200 | 4200 |

Both resulting yarns from the first and the second polymer are 27/20 (dtex/filaments). The POY yarns are then combined in the texturing process or in the draw winding process to form the melange yarns (see example 4 for texturing).

EXAMPLE 2

Nylon 6,10 Yarns

Polymer of the First Yarn (C):

A salt is formed by mixing water, sebasic acid and Hexamethylene diamine (HMD) at a ratio of 1.5:1.03:1.0 respectively, at 55° C. At this temperature, the formed solution is 44% by weight. The solution pH is then adjusted to 7.5–8.0 by adding HMD. The distillation and the polymerization processes are carried out in an autoclave for 100 minutes. At 250° C., the pressure is gradually dropped, while the polymerization proceeds, until atmospheric pressure is reached in the reactor. The polymer is then discharged from the autoclave under nitrogen pressure, and chilled by water. The discharged solid polymer streams are chopped to nylon 6,10 chips.

Polymer for the Second Yarn (D):

The process is similar to that described above for the first nylon 6,10 polymer, except for the additional 0.4% by weight of HMD that is added to the salt in the autoclave prior to the staring of polymerization process.

Spinning:

The desired polymer is spun in a POY process at 240° C. Each polymer is spun separately. The resulting first and second POY yarns are 55/34 (dtex/filaments).

These POY yarns are then combined in the texturing process or in the draw winding process to create the melange yarn (see example 5 for draw twisting).

EXAMPLE 3

Polymers for the first and the second yarns are prepared by the method described in Example 1. Spinning is carried under the following conditions:

| Conditions | Polymer A | Polymer B |
|---|---|---|
| Relative viscosity (RV) | 40 | 47 |
| Polymer temp. (° C.) | 298 | 298 |
| Extruder pressure (atm) | 100 | 100 |
| Pack pressure (atm) | 233 | 240 |
| Spin finish concentration (%) | 0.45 | 0.45 |
| Winding speed (m/min) | 4200 | 4200 |

Both resulting yarns from the first and the second polymer are 55/34 (dtex/filaments). The first yarn has 42 meq/Kg, and the second yarn has 88 meq/Kg. Both yarns contain 0.3% by weight titanium dioxide. The POY yarns are then combined in the texturing process, or in the draw twisting process to create the melange yarns (see Example 4 for texturing).

EXAMPLE 4

This example describes the process in which the high amino yarn and the low amino yarn are textured simultaneously on adjacent positions in a standard texturing machine. One yarn is textured on position "S" while the other yarn is textured on position "Z" of a "Scragg 1200" machine. The two yarns are then jointly placed in an air intermingling jet to be combined into a double ply yarn, which constitutes the textured melange product.

The table below lists the conditions of the texturing machine that are used for combining the yarns to obtain an effective melange yarn. The yarns described in this example are the resulting textured POY yarns described in Examples 1 and 3. Two 27/20 POY yarns with high and low amino are combined to form double ply yarn 22/20/2 product, and also two 55/34 yarns with high and low amino are combined to result in a double ply 44/34/2 product, under the following conditions:

| conditions | System 22/20/2 | System 44/34/2 |
|---|---|---|
| Texturing machine speed (m/min) | 683 | 683 |
| Healers temp. (° C.) | 210 | 210 |
| Ceramic discs arrangement | 1-5-1 | 1-7-1 |
| Air mingling pressure (atm) | 1.3 | 0.8 |
| Draw ratio | 1:1.3 | 1:1.3 |
| Heater length (m) | 2 | 2 |

EXAMPLE 5

This example describes the process in which the high and the low amino yarns of Example 2 are drawn simultaneously on adjacent positions of a Draw Winding machine. The two yarns are then jointly placed in an air intermingling device to be combined into a double ply yarn, which constitutes the FLAT melange product. The table below lists the conditions of the Draw Twisting machine that are used for combining the yarns to obtain an effective melange product, designated "88/68", as follows:

| conditions | System: 88/68 |
|---|---|
| Draw twisting speed (m/min) | 950 |
| Air mingling pressure (atm) | 1.5 |
| Draw ratio | 1:1.3 |

EXAMPLE 6

Dyeing Process:

The double ply melange yarn 44/34/2 of Example 4 is knitted on an 8-feed circular "santoni" machine. The resulting sleeves are then dyed in a laboratory Grandis MTCL-1 dyeing machine. The sleeve weight is 290 gr., and the dyeing is carried out in a 13-liter cup. The dye used is CIBA's Polar Blue acid dye. The dyestuff mixture contains the following components:

Leveling agent (13gr) by Univadim PA, antifoam agent 2.6 gr) by Albegal FFD, and Polar Blue dyestuff (5.2 gr). The dyeing bath temperature is raised to 40° C. The dyestuff mixture is dissolved in a small auxiliary cup, and then the content is transferred to the 13-liter dyeing bath. In order to achieve uniform mixing, the solution in the bath is further circulated for 10 minutes.

The bath temperature is raised to 96° C. at a rate of 2° C., for about 30 minutes.

The solution in the bath is circulated for additional 45 minutes, while keeping the temperature constant. The bath is then cooled to 80° C. over 8–10 minutes, followed by draining and rinsing the sleeves with water at 40° C.

The sleeves are dyed in shades of blue having a melange effect. The differential depth of the color has been measured by a ASTM D-1925-70, E-313-73, and E-308-85 method. This method uses the Reflection and Gloss of the fabric by a Photovolt model 575 with a Y sensor unit that determines indirectly the color intensity of the object by measuring the light reflected from the surface, at a chosen wavelength determined by a proper filter. In this method a relative value is measured and compared to a reference system, termed "Patron". In the present invention, the reference is the yarn with the lower level of amino end-groups, while the other yarn has the higher level of amino end-groups. To be an effective combination, which results in a desired color effect, the photovolt difference is typically approx. 2–3 units.

EXAMPLE 7

The following results illustrate the properties of POY 55/34, high amino end- group yarn, which is used for the textured melange yarn.

| Property | Value |
|---|---|
| Dtex | 58 |
| Elongation (%) | 74 |
| Tenacity (cN/dtex) | 3.5 |

The following results are properties of textured melange yarn 44/34/2

| Property | Value |
|---|---|
| Dtex | 93.2 |
| Elongation (%) | 22.5 |
| Tenacity (cN/dtex) | 3.5 |
| Intermingling points | 68 |

While embodiments of the invention have been described by way of illustration, it will be understood that the invention can be carried out by persons skilled in the art with many modifications, variations and adaptations, without departing from its spirit or exceeding the scope of the claims.

What is claimed is:

1. A process for the manufacture of a differentially dyeable nylon yarn, comprising the steps of:

producing a first polymer by polymerizing a salt of hexamethylene diamine and a diacid;

producing a second polymer by polymerizing a salt of hexamethylene diamine and a diacid with the addition of hexamethylene diamine;

spinning yarns from said two polymers; and intermingling said spun yarns made from said two polymers to produce a melange yarn therefrom.

2. A process according to claim 1 wherein said intermingling of said spun years is carried out in a textile process selected from the group consisting of texturing, draw twisting and draw winding processes.

3. A process according to claim 1, wherein said two polymers are made from the same monomer or co-monomers.

4. A process according to claim 1, wherein said different concentrations between the amine end-groups of said two polymers differ by at least 40 meq/kg.

5. A process according to claim 4 wherein said two polymers comprise a first polymer and a second polymer, and wherein said amine end-groups concentration of said first polymer is in the range of 20–50 meq/kg, and said amine end-group concentration of said second polymer is in the range of 60–95 meq/kg.

6. A process according to claim 5 wherein said amine end-groups concentration of said first polymer is about 45 meq/kg, and said amine end-group concentration of said second polymer is about 85 meq/kg.

7. A process according to claim 1, wherein said intermingling of said spun yarns produces a number of intermingling points between 10 and 75 points/meter.

8. A process according to claim 7 wherein said number of intermingling points is about 35 points/meter.

9. A process according claim 1, wherein said two polymers are selected from the group consisting of Nylon 6,6, Nylon 6,9 and Nylon 6,10.

10. A process according to claim 1, including dyeing said melange yarn in a single step.

11. A process according to claim 10, wherein said dyeing includes an acid dyestuff designed for polyamides.

12. A process according to claim 1, wherein one of said two polymers comprises Nylon 6,6 and the other of said two polymers comprises a different polyamide.

13. A process according to claim 12, wherein the relative viscosity of said Nylon 6,6 is in the range of RV=36–65.

14. A process according to claim 1 wherein said salts are formed by mixing water, said diacid, and said hexamethylene diamine.

* * * * *

UNITED STATES PATENT AND TRADEMARK OFFICE

CERTIFICATE OF CORRECTION

PATENT NO. : 6,524,503 B2 
DATED : February 25, 2003
INVENTOR(S) : Samuel Gazit et al.

It is certified that error appears in the above-identified patent and that said Letters Patent is hereby corrected as shown below:

Column 1,
Line 50, delete “in” and insert therefor -- it --.

Column 2,
Line 8, “hae” should read -- have --.
Line 19, after “dyestuffs” delete “,”.
Line 24, after “Dyeing” insert -- , --.

Column 3,
Line 50, after “to” insert -- a --.
Line 51, delete “comprising the” and insert therefor -- comprises a --.

Column 4,
Line 18, delete “from” and insert therefor -- of --.
Line 38, after “acid” insert -- ) --.
Line 50, delete “mes/kg” and insert therefor -- meq/kg --.
Lines 52 and 53, delete “meg/kg” and insert therefor -- meq/kg --.

Column 6,
Line 66, after “carried” insert -- out --.

Column 8,
Line 31, after “for” insert -- an --.
Line 67, after “44/34/2” insert -- . --.

Column 9,
Line 29, delete “years” and insert therefor -- yarns --.

Signed and Sealed this

Twelfth Day of August, 2003

JAMES E. ROGAN
*Director of the United States Patent and Trademark Office*